US008481877B2

(12) United States Patent
Chen

(10) Patent No.: US 8,481,877 B2
(45) Date of Patent: Jul. 9, 2013

(54) DUST-PROOF MACHINE TOOLS

(75) Inventor: Bach Pangho Chen, Claremont, CA (US)

(73) Assignee: X' Pole Precision Tools Inc., Jhongli, Taoyuan County (TW)

( * ) Notice: Subject to any disclaimer, the term of this patent is extended or adjusted under 35 U.S.C. 154(b) by 247 days.

(21) Appl. No.: 13/019,668

(22) Filed: Feb. 2, 2011

(65) Prior Publication Data

US 2012/0193199 A1 Aug. 2, 2012

(51) Int. Cl.
*H01H 13/06* (2006.01)

(52) U.S. Cl.
USPC ..... 200/302.2

(58) Field of Classification Search
USPC ..... 200/302.1, 302.2, 302.3, 333, 332.2, 200/505, 520, 323, 325, 341
See application file for complete search history.

(56) References Cited

U.S. PATENT DOCUMENTS 3,843,855 A * 10/1974 Danielson ..... 200/83 J
4,313,685 A * 2/1982 Stahl et al. ..... 400/479
4,376,240 A * 3/1983 Stuart ..... 200/43.17
4,831,223 A * 5/1989 Wako ..... 200/517
7,291,796 B2 * 11/2007 Liu et al. ..... 200/520
2008/0023315 A1 * 1/2008 Morisawa ..... 200/520

FOREIGN PATENT DOCUMENTS

TW 517618 1/2003
TW M245007 10/2004

* cited by examiner

*Primary Examiner* — Edwin A. Leon
*Assistant Examiner* — Anthony R Jimenez
(74) *Attorney, Agent, or Firm* — Muncy, Geissler, Olds & Lowe, PLLC

(57) ABSTRACT

A dust-proof machine tool which has a handgrip with an aperture to hold a driving switch movable up and down and a control bar hinged thereon to generate a pivotable stroke to press the driving switch. The handgrip is coupled with a dust-proof cover which has an opening to couple on the driving switch and a press portion formed on the perimeter of the opening to press the handgrip and seal the aperture. Thereby during operation of the machine tool, dust can be prevented from entering the machine tool through the driving switch and the aperture to maintain steady operation of the machine tool and enhance the lifespan thereof.

4 Claims, 6 Drawing Sheets

DUST-PROOF MACHINE TOOLS

FIELD OF THE INVENTION

The present invention relates to a dust-proof machine tool and particularly to a dust-proof switch for a machine tool to prevent dust from entering the machine tool.

BACKGROUND OF THE INVENTION

Machine tools generally are made in small size and lower cost, and can be coupled with different application tools to form a wide variety of styles, such as grinding discs, emery wheel machines, drilling machines, electric wrenches and the like, to assist operators to quickly perform certain tasks, thus are popularly accepted on the market. Besides electric power tools driven by electric power, there are also pneumatic tools driven by pressurized air.

However, when a machine tool is operating, dust is easily generated and could affect workpieces or cleanness of environments. Hence most machine tools now on the market are equipped with a dust suction device to clean the dust generated during operation. For instance, R.O.C. patent No. M245007 discloses an air exhaust apparatus for pneumatic grinders. It mainly includes a body with an upper extension and a lower extension extended from the circumference of the body and formed in a juxtaposed fashion. The upper extension has an air intake vent connected to an air intake duct. The lower extension has a dust hood at a lower side that has an opening to hold a grinding disc. The grinding disc has dust suction apertures. The lower extension further has a dust collection duct at a lateral side connected to a dust collection bag. When the air intake duct introduces air to drive the grinder to operate, the dust generated during grinding of the grinding disc is introduced through the dust suction apertures and passes through the dust hood to enter the lower extension of the body, and then is further directed through the dust collection duct to enter the dust collection bag coupled on a distal end of the dust collection duct.

R.O.C. patent No. 517618 also discloses an air exhaust apparatus for pneumatic grinders. It includes a grinding wheel with dust suction apertures formed thereon and a dust-proof cover located at the upper end of the grinding wheel. The dust-proof cover is fastened to a motor casing which has a chamber to hold an air motor set with movable vanes. The motor casing has an air intake duct and an air discharge duct extended from one side thereof and formed integrally. The air intake duct and air discharge duct hold respectively an air intake valve set and an air discharge muffler set, and also form a housing chamber to hold a throttle valve and a regulation knob, two opposing wings extended from the top surface thereof and formed integrally, and a movable air intake trigger located thereon. The dust-proof cover contains a holding trough extended therefrom and pivotably connected to an air exhaust duct of the motor casing. The holding trough is extended to a duct junction of the dust-proof cover. The air exhaust duct of the motor casing has an L-shaped tube with a lower end coupled with a flow guiding plate so that airflow generated by the movable vanes of the air motor set is discharged upwards through an air outlet. The tube has a lower end extended close to a front end of an outlet of the duct junction of the dust-proof cover so that the exhaust air of the motor and the outlet of the duct junction of the dust-proof cover form a converged location where the dust can be rapidly sucked and removed due to the powerful exhaust airflow during grinding. The regulation knob is held at a junction of the air exhaust duct and the air discharge duct, and has a carved portion and a wall to control the selection of an air exhaust path through the air exhaust duct or the air discharge duct.

All the aforesaid conventional techniques of the machine tools clean dust by installing a dust collection duct at one side of the machine tool to suck the dust during operation of the machine tool. The dust collection duct can only clean part of the dust at certain positions, especially at the operating position. Furthermore, the conventional machine tool has an installation hole on the handgrip to install a pressing switch which is depressed to activate operation of the machine tool. As dust generated everywhere during operation of the machine tool, it easily enters the machine tool through gaps formed between the pressing switch and installation hole, and even invade the interior of the cylinder that is rotated at a high speed to cause damage of the internal elements of the machine tool.

SUMMARY OF THE INVENTION

The primary object of the present invention is to solve the aforesaid disadvantages and prevent dust from entering the machine tool through the location of the switch to cause damage thereof.

To achieve the foregoing object, the present invention provides a dust-proof machine tool that includes a handgrip and a dust-proof cover located thereon. The handgrip which has an aperture to hold a driving switch movable up and down, and a control bar hinged thereon and having a pivotable stroke against the handgrip to press the driving switch to activate operation of the machine tool. The dust-proof cover is located on the handgrip, and has an opening coupled on the driving switch and a press portion formed on the circumference of the dust-proof cover where the opening is located to press the handgrip and seal the aperture so that dust cannot enter the machine tool through the driving switch and aperture.

In an embodiment of the invention, the driving switch and dust-proof cover are interposed by an elastic element to brace the driving switch upwards. The handgrip has a detent wall protruded and extended from the perimeter of the aperture to surround the driving switch. The press portion of the dust-proof cover butts the outer circumference of the detent wall to seal the aperture. The driving switch further has an insertion portion running through the aperture and dust-proof cover. The aperture has an annular portion on the perimeter thereof. The insertion portion of the driving switch has a retaining portion latching on the annular portion. In addition, the dust-proof cover has convex sections and concave sections spaced from each other alternately, and has an insertion hole run through by the insertion portion. The driving switch also has a first butting portion extended from the insertion portion and exposed outside the dust-proof cover. The insertion hole has a second butting portion on the perimeter to butt the first butting portion.

By means of the technique set forth above, compared with the conventional techniques, the invention can maintain steady operation of the machine tool and enhance the lifespan thereof.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
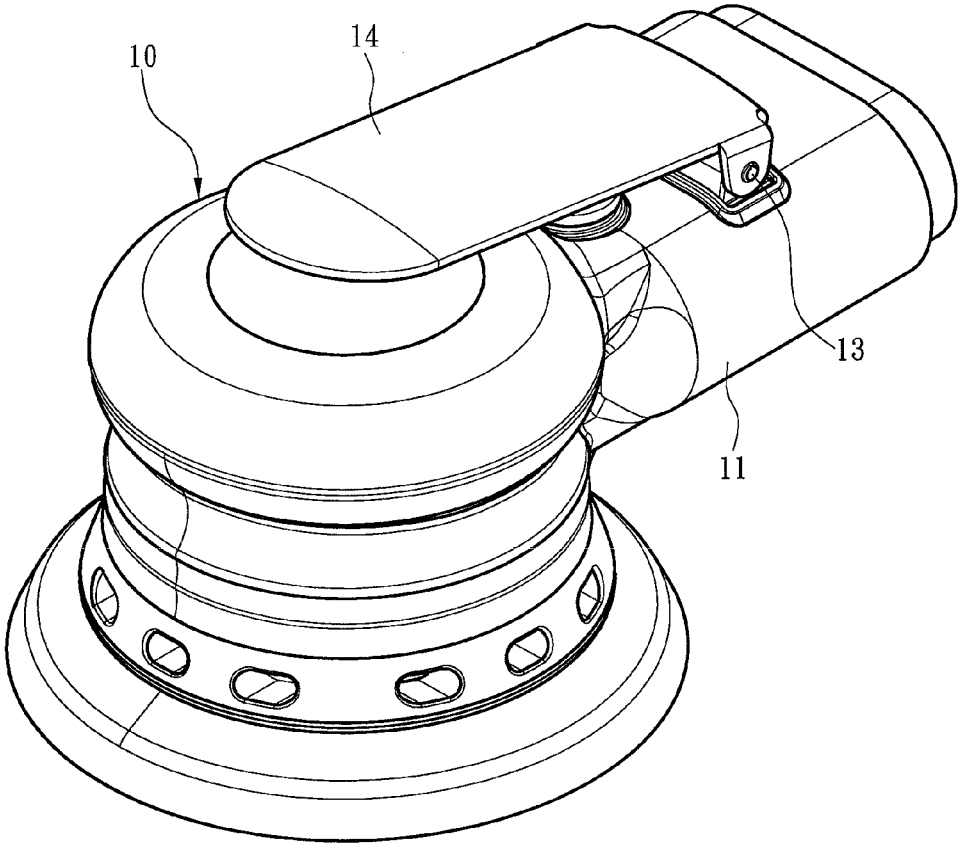
FIG. 1 is a perspective view of the invention.
Figure 2:
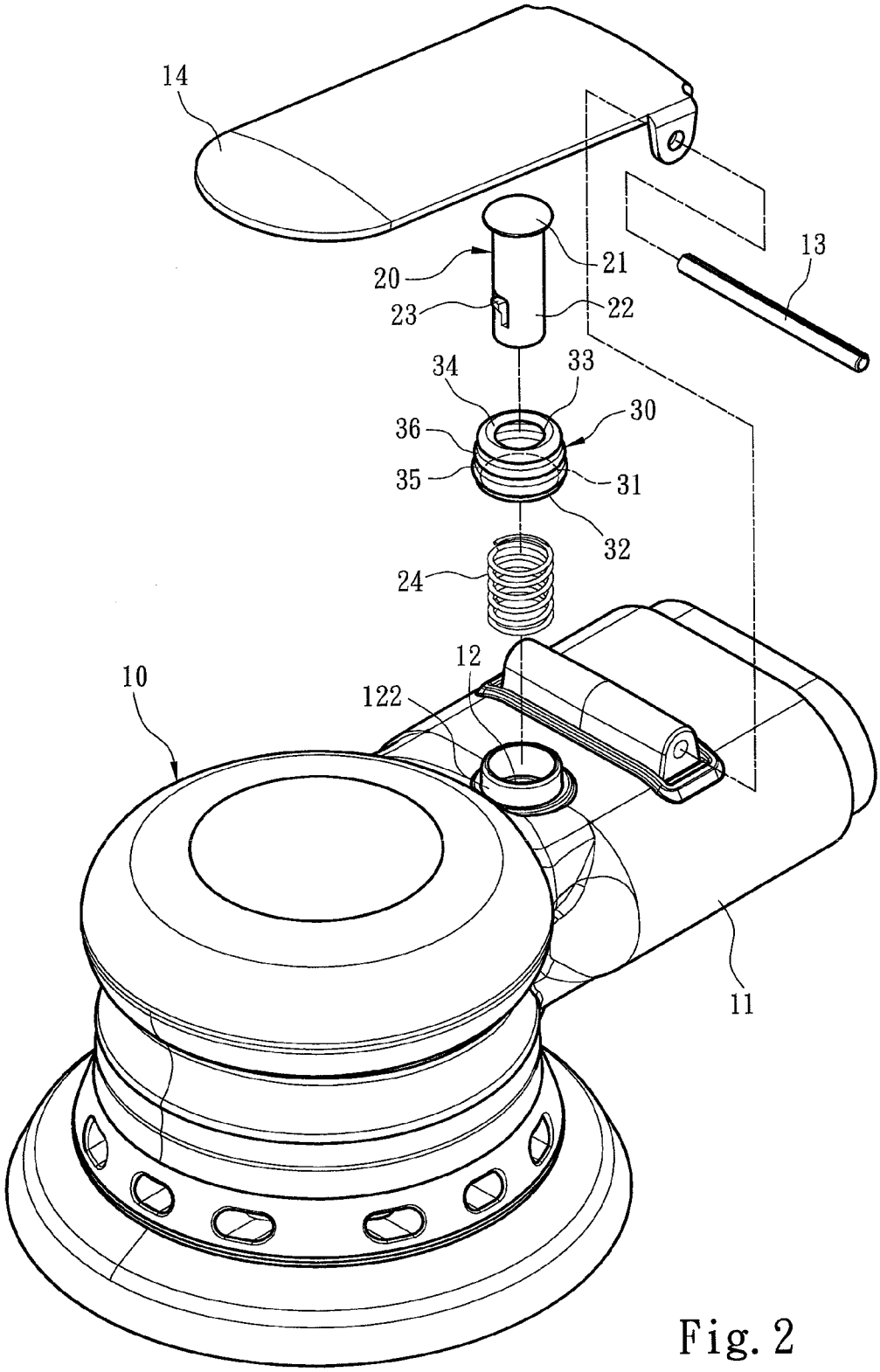
FIG. 2 is an exploded view of the invention.

Please refer to FIGS. 1 and 2, the present invention provides a dust-proof machine tool 10, and includes mainly a handgrip 11 and a dust-proof cover 30 located thereon. The handgrip 11 with an aperture 12 formed thereon to hold a driving switch 20. The aperture 12 has an annular portion 121 (referring to FIG. 3B) on the perimeter and a detent wall 122 protruded upwards to surround the driving switch 20.

Figure 3A:
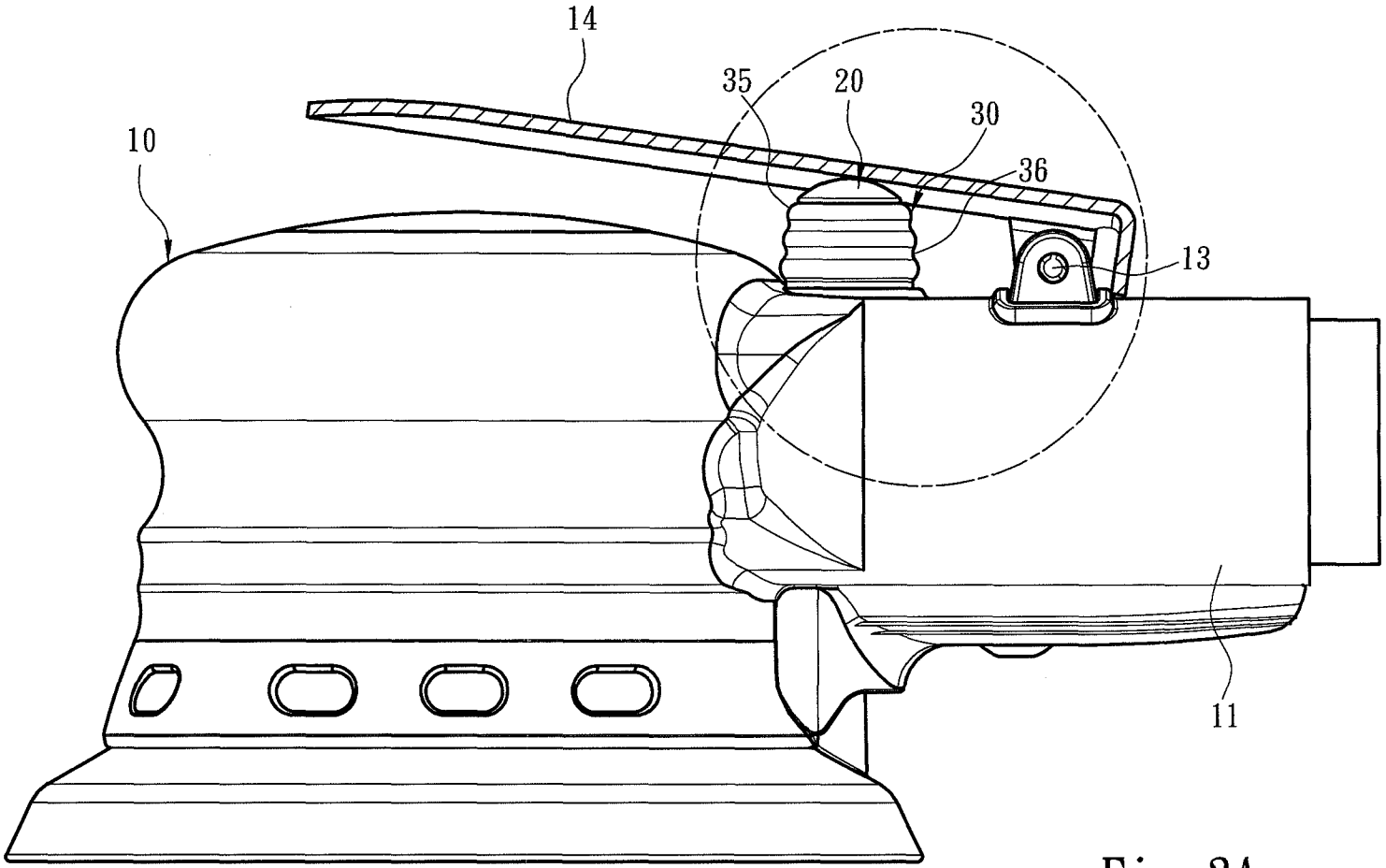
FIG. 3A is a schematic view of the invention in a use condition.
Figure 3B:
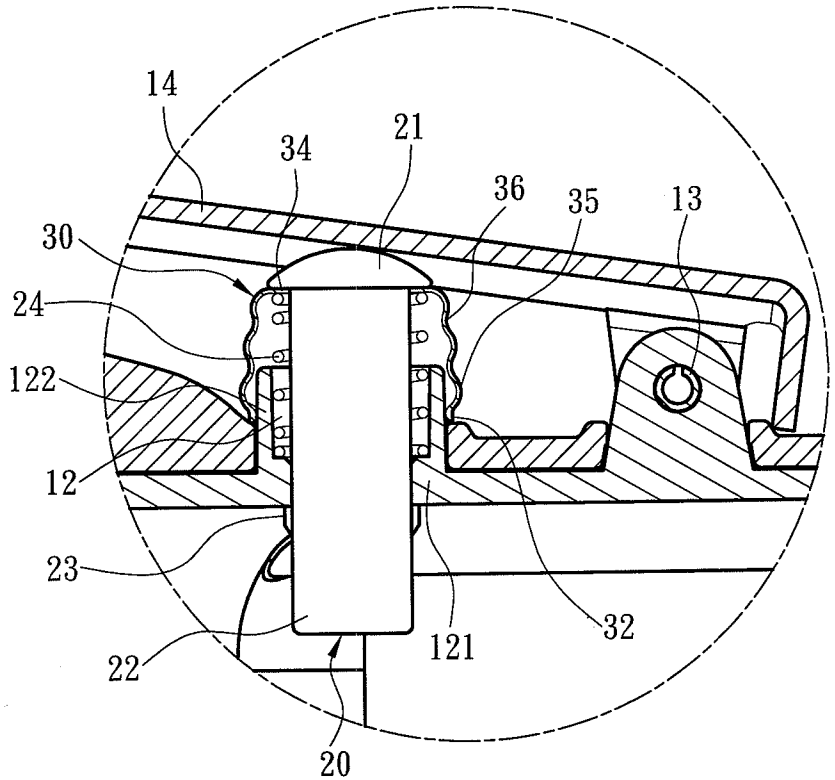
FIG. 3B is an enlarged fragmentary sectional view according to FIG. 3A.

Also referring to FIGS. 3A and 3B, the driving switch 20 has an insertion portion 22 running through the aperture 12, a first butting portion 21 extended from the insertion portion 22, a retaining portion 23 located on the insertion portion 22, and an elastic element 24, such as a spring, run through by the insertion portion 22. The elastic element 24 has one end butting the upper side of the annular portion 121 and another end butting the first butting portion 21 of the driving switch 20 so that the driving switch 20 is pushed upwards by the elastic force of the elastic element 24 in normal conditions, and also is latched on the lower side of the annular portion 121 through the retaining portion 23. Moreover, the handgrip 11 also has a control bar 14 hinged thereon through a pivot 13. Hence the control bar 14 can generate a pivotable stroke against the handgrip 11 to press the driving switch 20 to activate operation of the machine tool 10.

The dust-proof cover 30 is coupled on the outer sides of the driving switch 20 and the elastic element 24 with the elastic element 24 interposed between the driving switch 20 and the dust-proof cover 30. The dust-proof cover 30 has an opening 31 at one end to couple on the driving switch 20 and a press portion 32 formed on the circumference of the dust-proof cover 30 where the opening 31 is located to press the detent wall 122 of the handgrip 11 and surround the aperture 12, and an insertion hole 33 at another end run through by the insertion portion 22 of the driving switch 20. The insertion hole 33 has a second butting portion 34 formed on the perimeter thereof to butt the first butting portion 21 with the first butting portion 21 exposed outside the dust-proof cover 30. Thus forms the main structure of the invention. When the machine tool 10 is in operation, dust is prevented from entering the driving switch 20 and aperture 12.

Figure 4A:
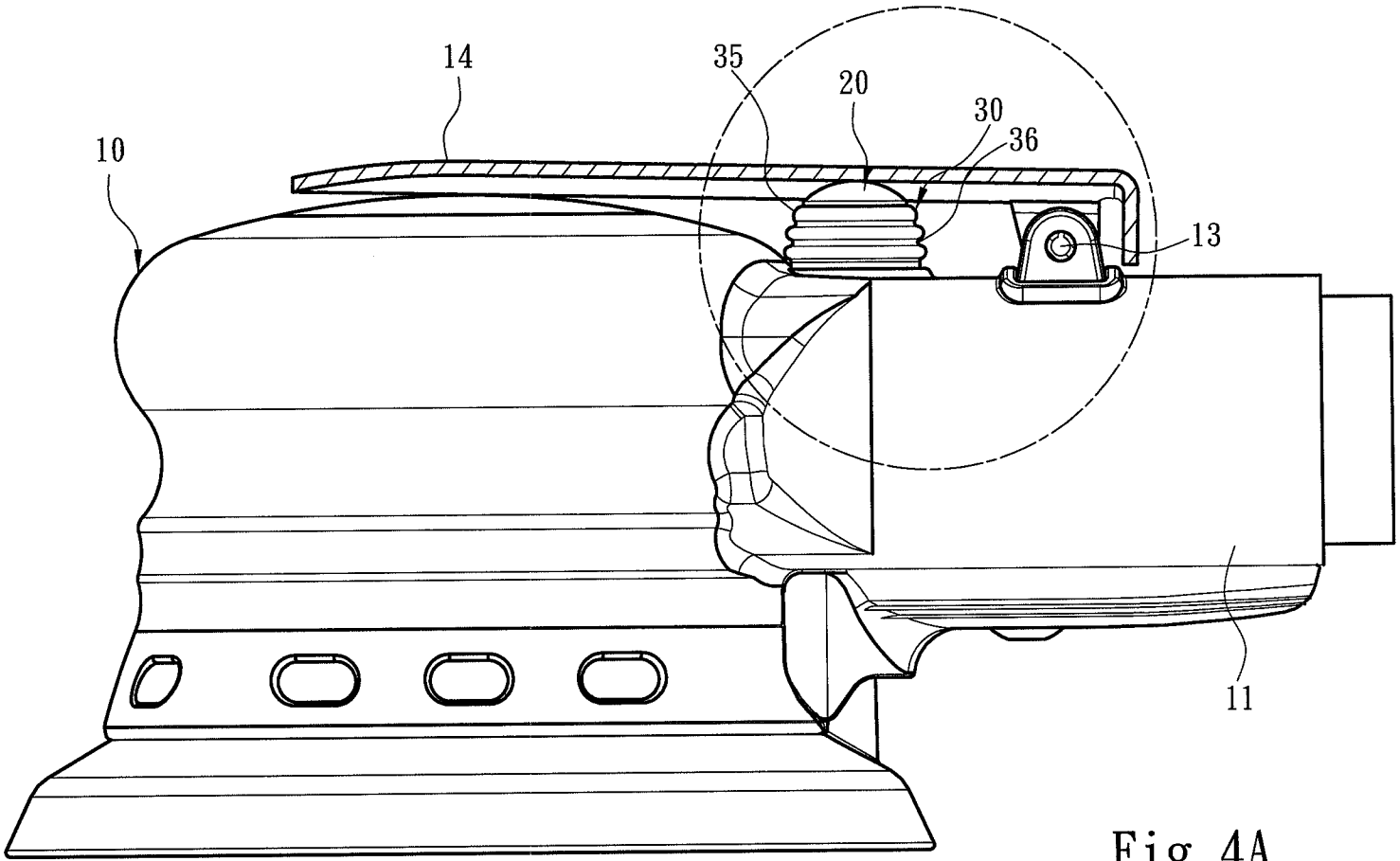
FIG. 4A is a schematic view of the invention in another use condition.
Figure 4B:
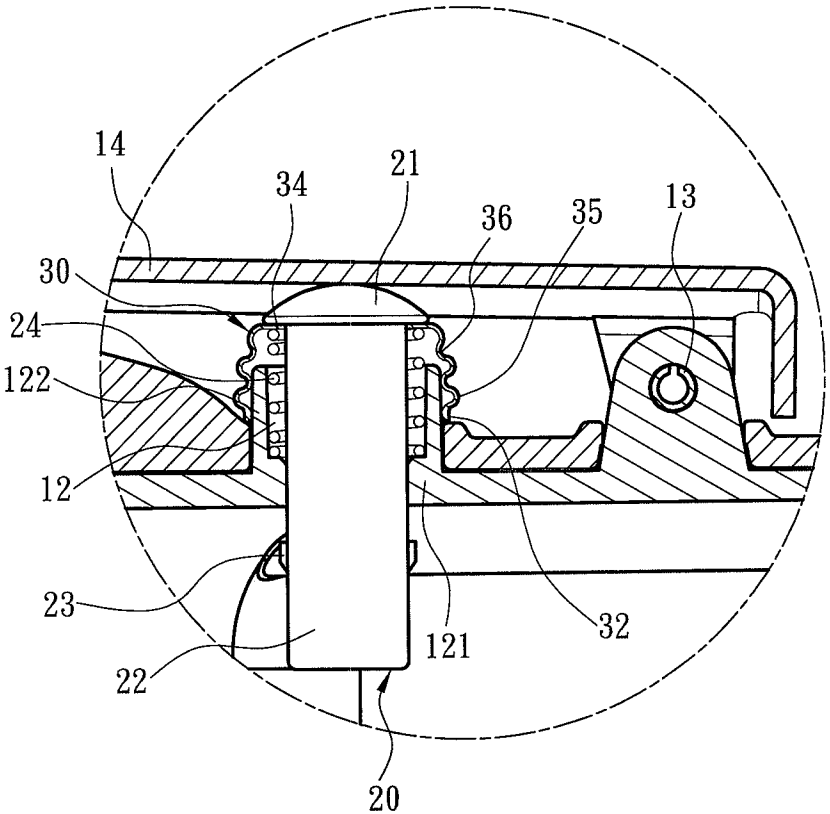
FIG. 4B is an enlarged fragmentary sectional view according to FIG. 4A.

Also referring to FIGS. 4A and 4B, the dust-proof cover 30 has convex sections 35 and concave sections 36 spaced from each other alternately. When the control bar 14 is pivoted downwards to press the driving switch 20, the driving switch 20 presses the elastic element 24 and the second butting portion 34 through the first butting portion 21, so that the elastic element 24 is pushed by the driving switch 20 to be compressed; moreover, after the dust-proof cover 30 is pushed by the driving switch 20, it is compressed through deformation of the convex sections 35 and concave sections 36. The dust-proof cover 30 can be made of a flexible material, such as rubber, to achieve sealing and dust-proof effect. Moreover, the flexibility of the dust-proof cover 30 also can drive the up and down movement of the driving switch 20 without installing the elastic element 24. As a result, production cost is reduced and assembling time also can be saved.

As a conclusion, the invention mainly provides an aperture 12 on the handgrip 11 of the machine tool 10 to hold a driving switch 20 which is coupled with a dust-proof cover 30. The dust-proof cover 30 has an opening 31 run through by the insertion portion 22 of the driving switch 20 and a press portion 32 formed on the circumference of the dust-proof cover 30 where the opening 31 is located to press the handgrip 11 and surround the aperture 12 so that dust generated during operation of the machine tool 10 cannot enter the machine tool 10 through the driving switch 20 and aperture 12. As a result, the internal elements in the machine tool 10 are free from abrasion of the dust and damage can be prevented, thus the machine tool 10 can be operated steadily and the lifespan thereof also can be enhanced.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A dust-proof machine tool, comprising:

a handgrip which includes an aperture to hold a driving switch movable up and down and a control bar hinged thereon to generate a pivotable stroke to press the driving switch, wherein the driving switch includes an insertion portion running through the aperture and a first butting portion extended from the insertion portion;

a dust-proof cover including an opening run through by the insertion portion of the driving switch, an insertion hole formed on one side opposite to the opening, a press portion formed on the circumference thereof where the opening is located to press the handgrip and seal the aperture, and a second butting portion formed on the perimeter thereof where the insertion hole is located to butt the first butting portion such that the first butting portion is exposed outside the dust-proof cover; and an elastic element which is interposed between the driving switch and the dust-proof cover, and includes a first end butting an inner edge of the aperture and a second end normally pushing the second butting portion to contact with the first butting portion and brace the driving switch upwards.

2. The dust-proof machine tool of claim 1, wherein the handgrip includes a detent wall protruded and extended from the perimeter of the aperture to surround the driving switch, the press portion of the dust-proof cover pressing the outer circumference of the detent wall.

3. The dust-proof machine tool of claim 1, wherein the aperture includes an annular portion of the perimeter, the insertion portion of the driving switch including a retaining portion latched on the annular portion.

4. The dust-proof machine tool of claim 1, wherein the dust-proof cover includes convex sections and concave sections spaced from each other alternately.

* * * * *